US008270853B2

(12) United States Patent
Shiraishi

(10) Patent No.: US 8,270,853 B2
(45) Date of Patent: Sep. 18, 2012

(54) IMAGE FORMING APPARATUS WITH PRINTING PROCESSING UNIT

(75) Inventor: Toyokazu Shiraishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 372 days.

(21) Appl. No.: 12/634,062

(22) Filed: Dec. 9, 2009

(65) Prior Publication Data

US 2010/0158549 A1 Jun. 24, 2010

(30) Foreign Application Priority Data

Dec. 19, 2008 (JP) ..... 2008-324663

(51) Int. Cl.
*G03G 15/00* (2006.01)

(52) U.S. Cl. ..... 399/24; 399/45

(58) Field of Classification Search ..... 399/24, 399/45

See application file for complete search history.

(56) References Cited

U.S. PATENT DOCUMENTS

| | | | | |
|---|---|---|---|---|
| 5,636,032 | A * | 6/1997 | Springett | 399/23 |
| 5,802,420 | A * | 9/1998 | Garr et al. | 399/24 |
| 6,453,129 | B1 * | 9/2002 | Simpson et al. | 399/24 |
| 6,584,291 | B1 * | 6/2003 | Yamamoto | 399/25 |
| 6,863,364 | B2 * | 3/2005 | Russell et al. | 399/24 |
| 2002/0140959 | A1 * | 10/2002 | Harper | 399/24 |
| 2009/0016744 | A1 * | 1/2009 | Kolb | 399/24 |

FOREIGN PATENT DOCUMENTS

JP 2001-162900 A 6/2001

* cited by examiner

*Primary Examiner* — Ryan Walsh
(74) *Attorney, Agent, or Firm* — Kubotera & Associates, LLC

(57) ABSTRACT

An image forming apparatus includes a consumable supply remaining amount detection unit for detecting a remaining amount of a consumable supply; a printable length detection unit for determining a printable length of a medium printable with the remaining amount; a printable length determining processing unit for determining whether the printable length is smaller than a requested print length of the medium requested with print data; and a printing processing unit for performing a partial printing operation when the printable length determining processing unit determines that the printable length is smaller than the requested print length.

14 Claims, 12 Drawing Sheets

| Toner remaining amount (%) | Printable length (m) |
|---|---|
| 100 | 4500.00 |
| 75 | 3375.00 |
| 50 | 2250.00 |
| 25 | 1125.00 |
| 10 | 450.00 |
| 0 | 0.00 |

FIG. 5

IMAGE FORMING APPARATUS WITH PRINTING PROCESSING UNIT

BACKGROUND OF THE INVENTION AND RELATED ART STATEMENT

The present invention relates to an image forming apparatus.

A conventional image forming apparatus such as a printer, a copier, a facsimile, a multi function product, and the likes is connected to a host computer. When an operator operates the host computer to perform a printing operation, the host computer retrieves a state of a consumable supply of the conventional image forming apparatus such as a remaining amount of toner stored in a toner cartridge or a toner remaining amount. Then, the host computer determines whether the printing operation can be preformed according to a print number and the toner remaining amount. When the host computer determines that the printing operation can be preformed, the host computer sends a print instruction to the conventional image forming apparatus. When the host computer determines that the printing operation cannot be preformed, the host computer notifies the operator that the printing operation cannot be performed (refer to Patent Reference).

Patent Reference: Japanese Patent Publication No. 2001-162900

In the conventional image forming apparatus, when the host computer determines that the printing operation cannot be preformed, the conventional image forming apparatus cannot perform the printing operation, thereby reducing availability of the conventional image forming apparatus.

In view of the problems described above, an object of the present invention is to provide an image forming apparatus capable of solving the problems and preventing availability of the image forming apparatus from lowering.

Further objects and advantages of the invention will be apparent from the following description of the invention.

SUMMARY OF THE INVENTION

In order to attain the objects described above, according to the present invention, an image forming apparatus includes a consumable supply remaining amount detection unit for detecting a remaining amount of a consumable supply; a printable length detection unit for determining a printable length of a medium printable with the remaining amount; a printable length determining processing unit for determining whether the printable length is smaller than a requested print length of the medium requested with print data; and a printing processing unit for performing a partial printing operation when the printable length determining processing unit determines that the printable length is smaller than the requested print length.

In the present invention, the image forming apparatus includes the consumable supply remaining amount detection unit for detecting the remaining amount of the consumable supply; the printable length detection unit for determining the printable length of the medium printable with the remaining amount; the printable length determining processing unit for determining whether the printable length is smaller than the requested print length of the medium requested with the print data; and the printing processing unit for performing the partial printing operation when the printable length determining processing unit determines that the printable length is smaller than the requested print length.

In the present invention, when the remaining amount of the consumable supply decreases, the printable length determining processing unit determines whether the printable length is smaller than the requested print length. When the printable length determining processing unit determines that the printable length is smaller than the requested print length, the printing processing unit performs the partial printing operation. Accordingly, it is possible to prevent availability of the image forming apparatus from lowering.

BRIEF DESCRIPTION OF THE DRAWINGS

FIG. 5 is a schematic view showing a table of a relationship between a toner remaining amount and a printable length according to the first embodiment of the present invention;

DETAILED DESCRIPTION OF THE PREFERRED EMBODIMENTS

Hereunder, embodiments of the present invention will be explained with reference to the accompanying drawings. A printer 10 of an electro-photography type will be explained as an image forming apparatus.

First Embodiment

Figure 2:
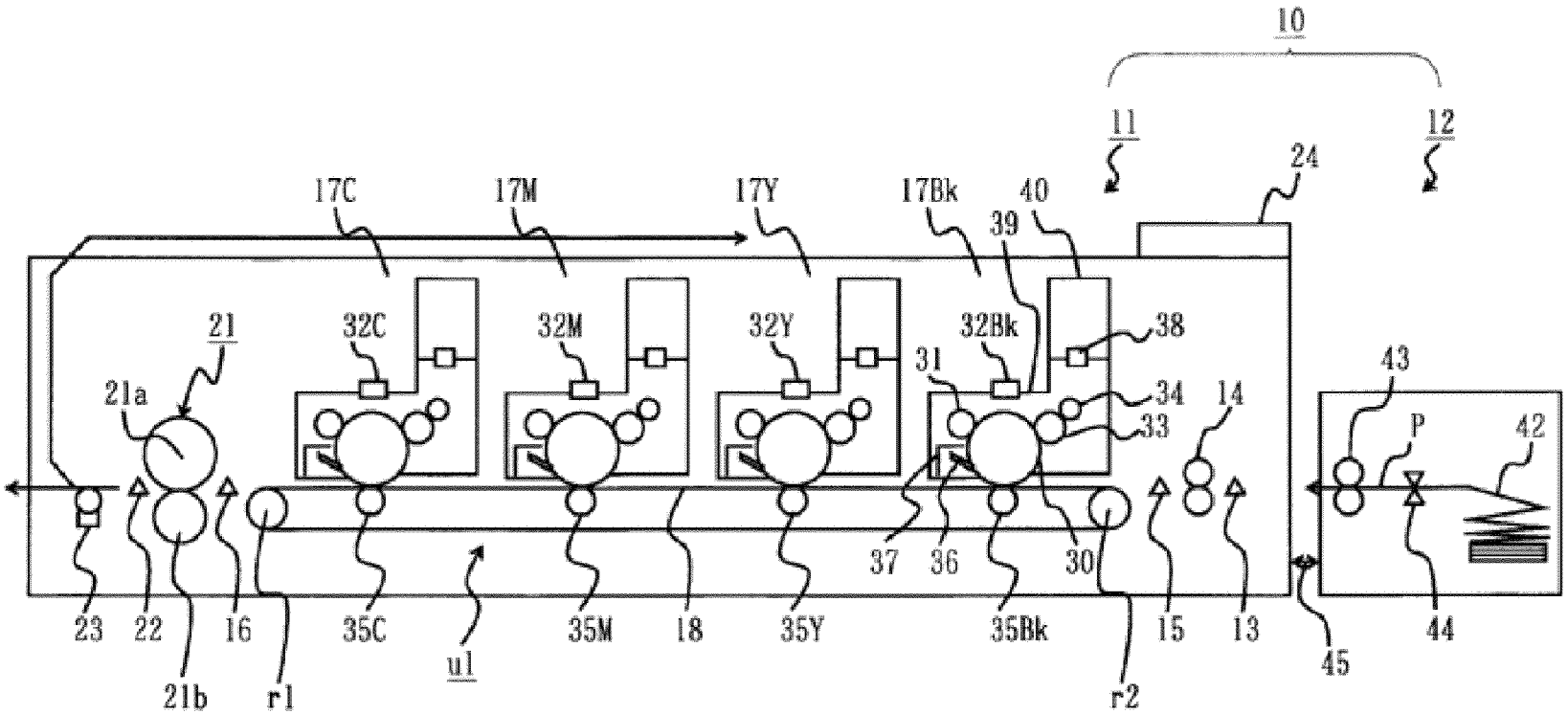
FIG. 2 is a schematic sectional view showing the printer according to the first embodiment of the present invention.

A first embodiment of the present invention will be explained. FIG. 2 is a schematic sectional view showing the printer 10 according to the first embodiment of the present invention.

As shown in FIG. 2, the printer 10 includes a printer main body 11; a medium supply mechanism 12 for supplying a continuous sheet P as a medium to the printer main body 11; and a communication cable 45 as a signal line for connecting the printer main body 11 and the medium supply mechanism 12.

In the embodiment, the printer main body 11 includes a sheet supply sensor 13 for detecting the continuous sheet P supplied in a transportation direction of the continuous sheet P; a register roller pair 14 as a first register medium transportation unit for correcting skew of the continuous sheet P; a writing sensor 15 as a writing detection unit for detecting a leading edge of the continuous sheet P; image forming units 17Bk, 17Y, 17M, and 17C for forming toner images as developer images in colors of black, yellow, magenta, and cyan; and a transfer unit u1 disposed below the image forming units 17Bk, 17Y, 17M, and 17C for sequentially transferring the toner image in colors to form a color toner image.

Further, the printer main body 11 includes LED (Light Emitting Diode) heads 32Bk, 32Y, 32M, and 32C disposed as exposure devices corresponding to the image forming units 17Bk, 17Y, 17M, and 17C; a slack sensor 16 as a slack detection unit for detecting a slack of the continuous sheet P; a fixing unit 21 as a fixing device for fixing the color toner image to the continuous sheet P; a discharge sensor 22 as a discharge detection unit for detecting the continuous sheet P discharged from the fixing unit 21; and a medium movement sensor 23 as a medium movement detection unit.

In the embodiment, the printer 10 further includes an operation panel 24 disposed on an upper surface of the printer main body 11. The operation panel 24 functions as an operation unit for receiving an instruction from an operator and a display unit for displaying a status of the printer 10.

In the embodiment, the medium supply mechanism 12 includes a continuous sheet retaining unit for retaining the continuous sheet P; a continuous sheet cutter 44 as a cutting device for cutting the continuous sheet P; and a register roller pair 43 as a second register medium transportation unit.

In the embodiment, each of the image forming units 17Bk, 17Y, 17M, and 17C includes a main body thereof or an image forming unit main body; and a toner cartridge 40 detachably attached to the image forming unit main body as a consumable supply retaining unit or a developer retaining unit for retaining toner as developer or a consumable supply. A toner sensor 38 is disposed between the image forming unit main body and the toner cartridge 40 for detecting toner supplied from the toner cartridge 40 to the image forming unit main body. When the printer 10 stops a printing operation, it is possible to replace the toner cartridge 40 through opening a top cover (not shown).

In the embodiment, the image forming unit main body includes a housing portion 39 as a housing; a photosensitive drum 30 as an image supporting member disposed in the housing portion 39; a charging roller 31 as a charging device; a developer roller 33 as a developer supporting member; a toner supply roller 34 as a developer supply member; a cleaning blade 36 as a cleaning member; a waste toner box 37 as a waste toner retaining portion; and the likes. The LED heads 32Bk, 32Y, 32M, and 32C are disposed to face the photosensitive drums 30.

In the embodiment, the transfer unit u1 includes a drive roller r1 as a drive rotating member; a follower roller r2 as a follower rotating member; a transfer belt 18 as a first transfer member extended with the driver roller r1 and the follower roller r2 to be rotatable when the drive roller r1 rotates; and transfer rollers 35Bk, 35Y, 35M, and 35C as a second transfer member disposed to face the photosensitive drums 30 through the transfer belt 18.

In the embodiment, the fixing unit 21 includes a fixing roller 21*a* as a first roller and a backup roller 21*b* as a second roller pressed against the fixing roller 21*a* with a specific pressure.

Figure 1:
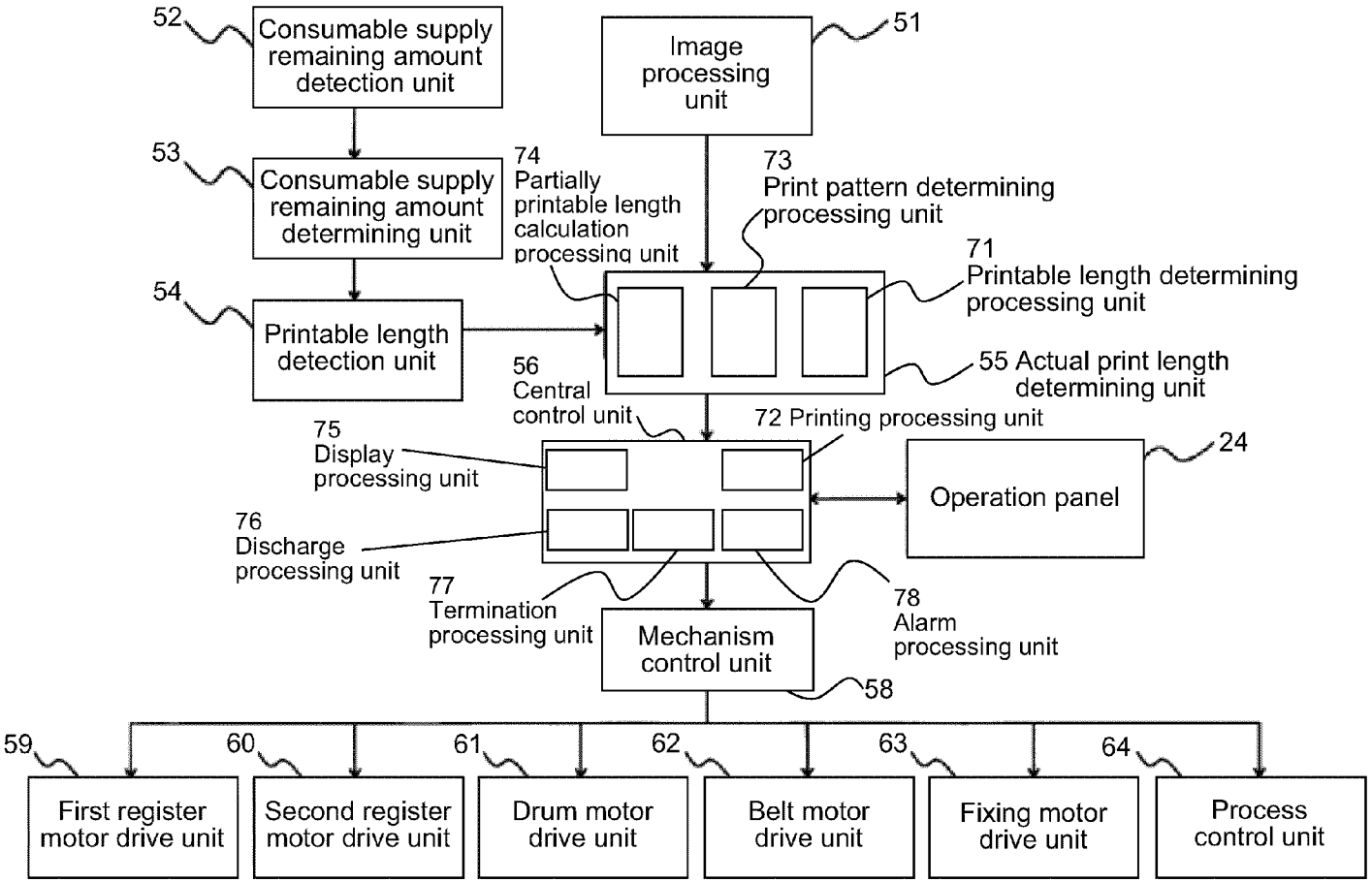
FIG. 1 is a block diagram showing a control system of a printer according to a first embodiment of the present invention.

A control system of the printer 10 will be explained next. FIG. 1 is a block diagram showing the control system of the printer 10 according to the first embodiment of the present invention.

As shown in FIG. 1, the control system of the printer 10 includes an image processing unit 51 for processing image data; a consumable supply remaining amount detection unit 52 for detecting a remaining amount of the consumable supply (a remaining amount of toner in the toner cartridge 40 or a toner remaining amount); and a consumable supply remaining amount determining unit 53 for determining the toner remaining amount detected with the consumable supply remaining amount detection unit 52; a printable length detection unit 54 for determining a length of the continuous sheet P printable with the toner remaining amount or a printable length; and an actual print length determining unit 55 for determining a print length of the continuous sheet P in an actual printing operation or an actual print length.

Further, the control system of the printer 10 includes a central control unit 56 as a first control unit for controlling an entire operation of the printer 10; an operation panel 24; and a mechanism control unit 58 as a second control unit for controlling mechanic components of the printer 10 such as the medium supply mechanism 12, the register roller pair 14, the image forming units 17Bk, 17Y, 17M, and 17C, the transfer unit u1, the LED heads 32Bk, 32Y, 32M, and 32C, the fixing unit 21, and the medium movement sensor 23.

In the embodiment, the mechanism control unit 58 sends an instruction to a first register motor drive unit 59 as a first transportation drive unit, so that the first register motor drive unit 59 drives a first register motor (not shown) to rotate the register roller pair 14. Further, the mechanism control unit 58 sends an instruction to a second register motor drive unit 60 as a second transportation drive unit, so that the second register motor drive unit 60 drives a second register motor (not shown) to rotate the register roller pair 43. Further, the mechanism control unit 58 sends an instruction to a drum motor drive unit 61 as an image forming drive unit, so that the drum motor drive unit 61 drives a drum motor (not shown) to rotate the photosensitive drums 30.

Further, the mechanism control unit 58 sends an instruction to a belt motor drive unit 62 as a third transportation drive unit, so that the belt motor drive unit 62 drives a belt motor (not shown) to rotate the drive roller r1 to move the transfer belt 18. Further, the mechanism control unit 58 sends an instruction to a fixing motor drive unit 63 as a fixing drive unit, so that the fixing motor drive unit 63 drives a fixing motor (not shown) to rotate the fixing roller 21*a*. Further, the mechanism control unit 58 sends an instruction to a process control unit 64 as a third control unit for controlling the image forming units 17Bk, 17Y, 17M, and 17C, the transfer unit u1, and the LED heads 32Bk, 32Y, 32M, and 32C.

Figure 3:
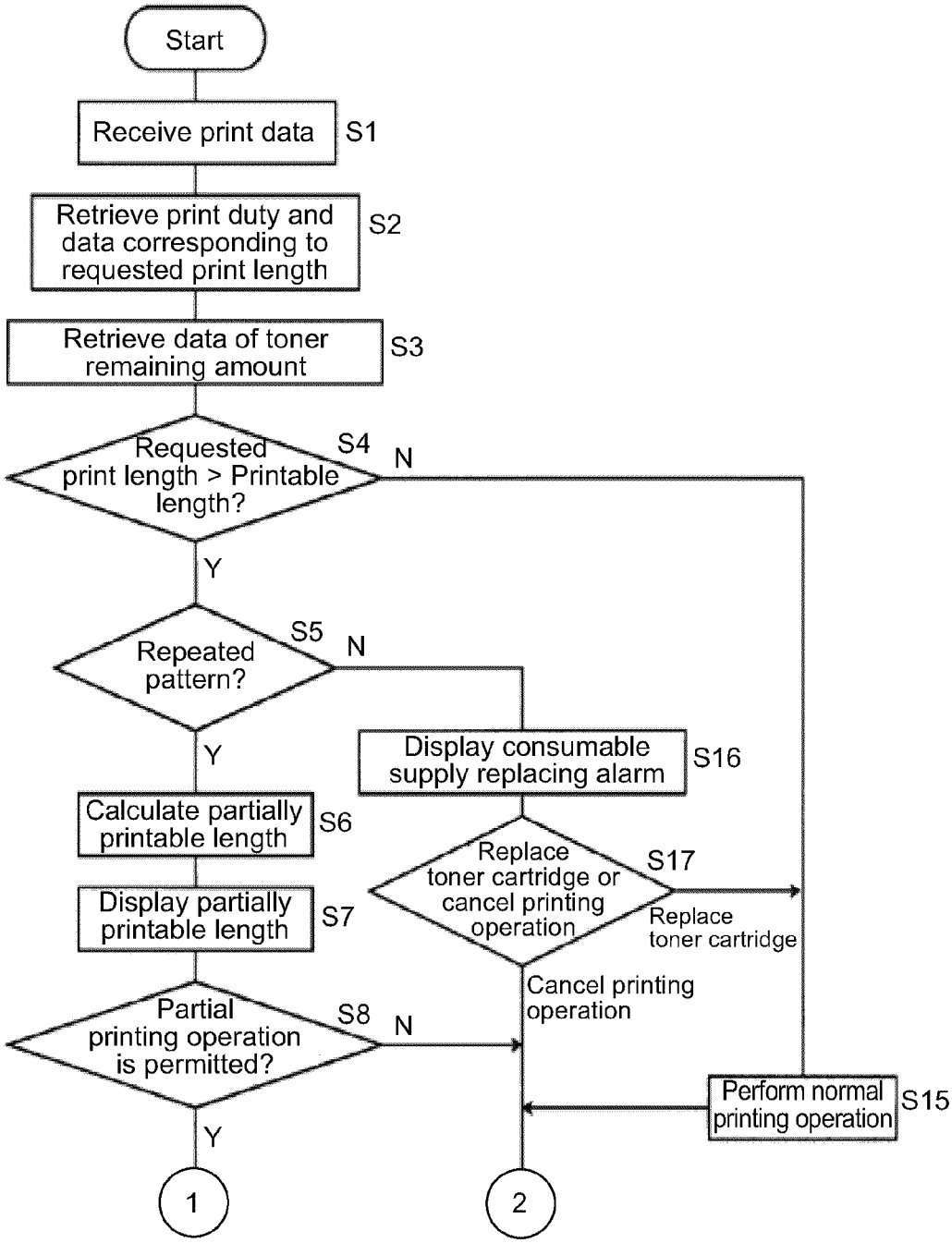
FIG. 3 is a flow chart No. 1 showing an operation of the printer according to the first embodiment of the present invention.

An operation of the printer 10 will be explained next. FIG. 3 is a flow chart No. 1 showing the operation of the printer according to the first embodiment of the present invention.

Figure 4:
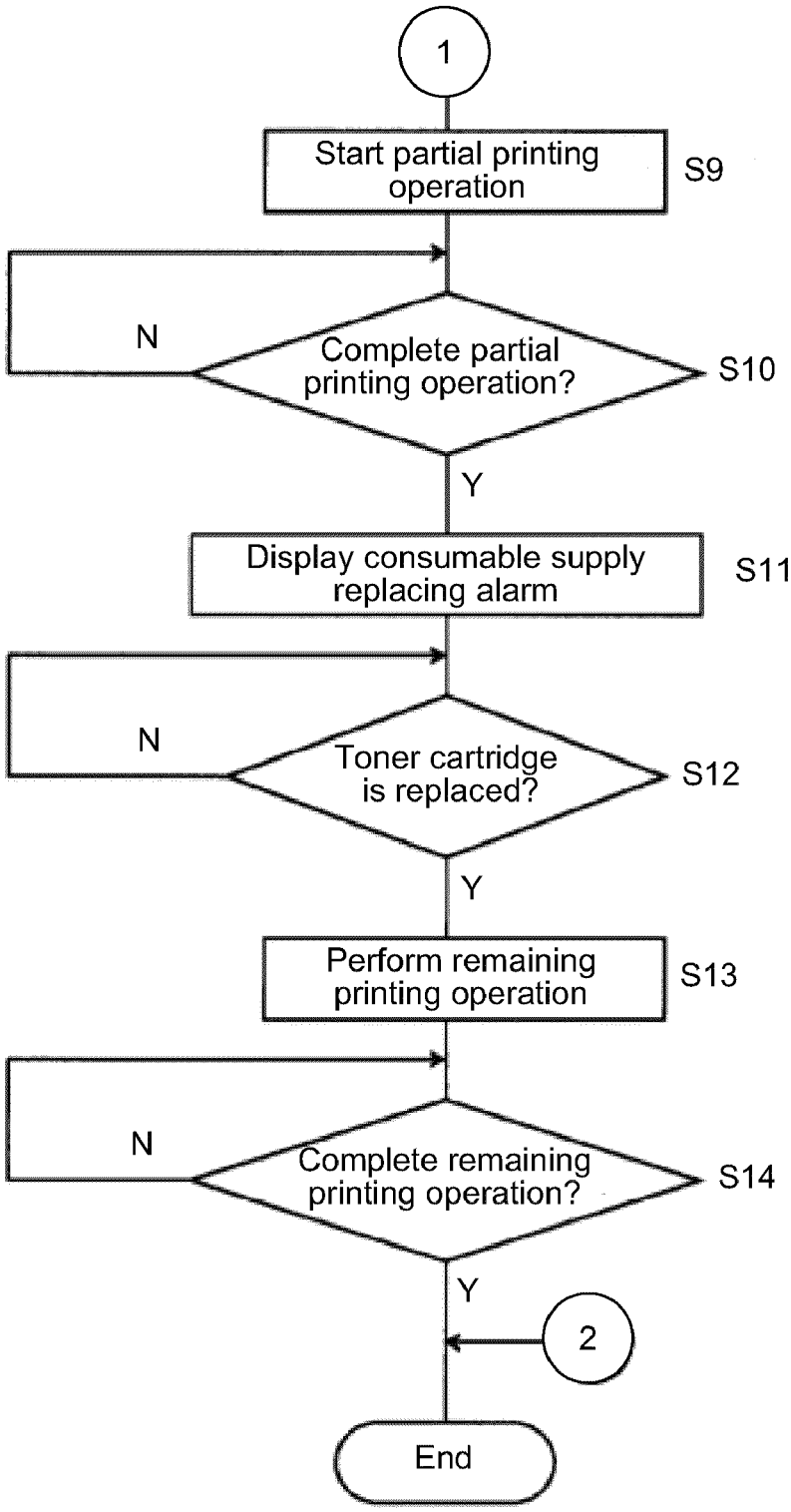
FIG. 4 is a flow chart No. 2 showing the operation of the printer according to the first embodiment of the present invention.

FIG. 4 is a flow chart No. 2 showing the operation of the printer according to the first embodiment of the present invention. FIG. 5 is a schematic view showing a table of a relationship between the toner remaining amount and the printable length according to the first embodiment of the present invention.

Figure 6:
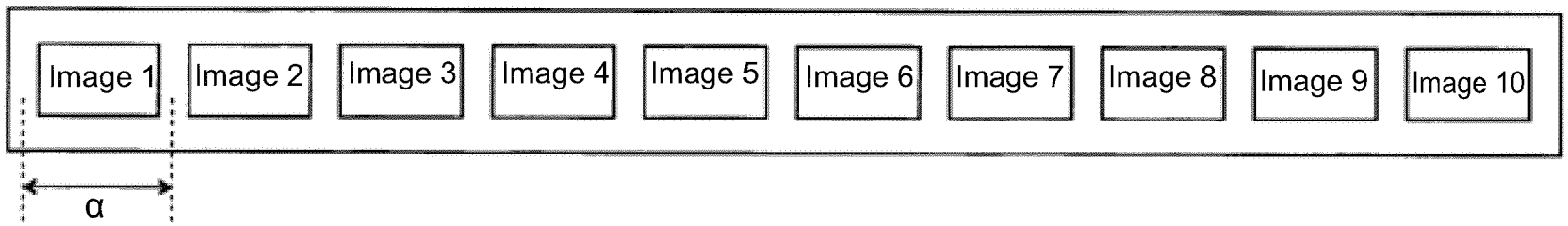
FIG. 6 is a schematic view showing an example No. 1 of a printed image according to the first embodiment of the present invention.
Figure 7:
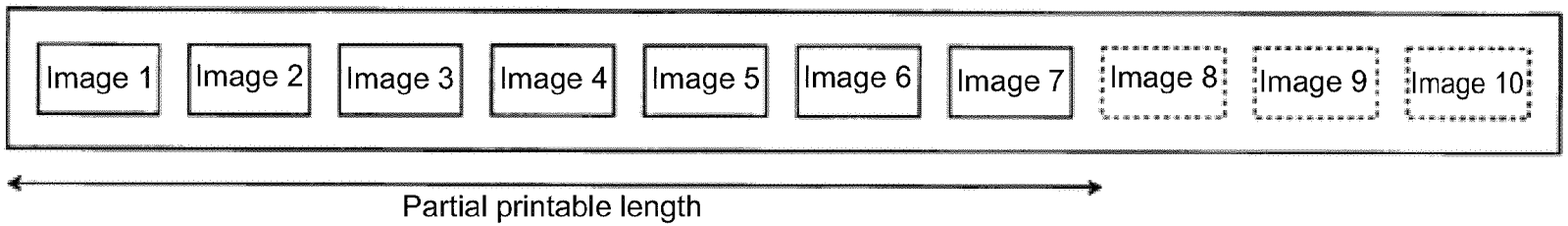
FIG. 7 is a schematic view showing an example No. 2 of the printed image according to the first embodiment of the present invention.
Figure 8:
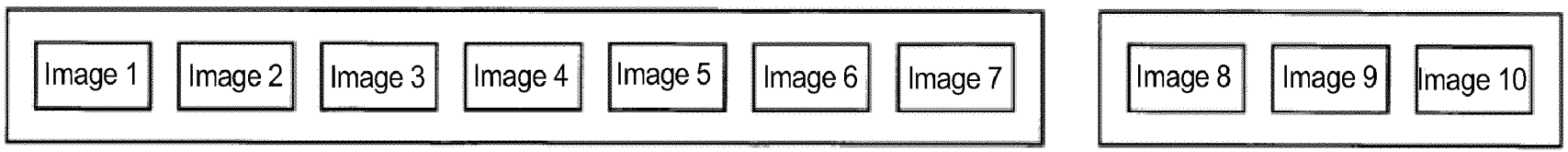
FIG. 8 is a schematic view showing an example No. 3 of the printed image according to the first embodiment of the present invention.

FIG. 6 is a schematic view showing an example No. 1 of a printed image according to the first embodiment of the present invention. FIG. 7 is a schematic view showing an example No. 2 of the printed image according to the first embodiment of the present invention. FIG. 8 is a schematic view showing an example No. 3 of the printed image according to the first embodiment of the present invention.

Figure 9:
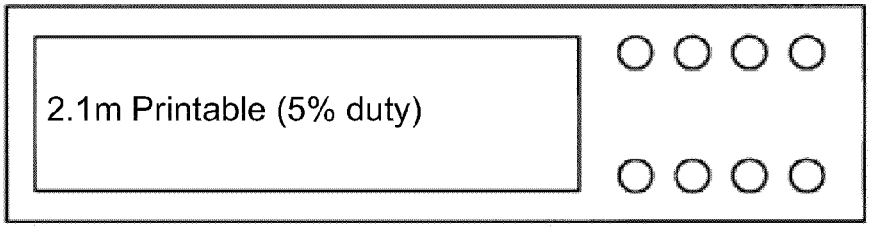
FIG. 9 is a schematic view showing an example No. 1 of a display state of an operation panel according to the first embodiment of the present invention.
Figure 10:
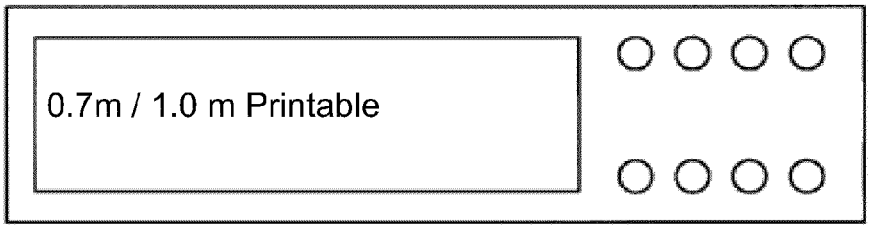
FIG. 10 is a schematic view showing an example No. 2 of the display state of the operation panel according to the first embodiment of the present invention.
Figure 11:
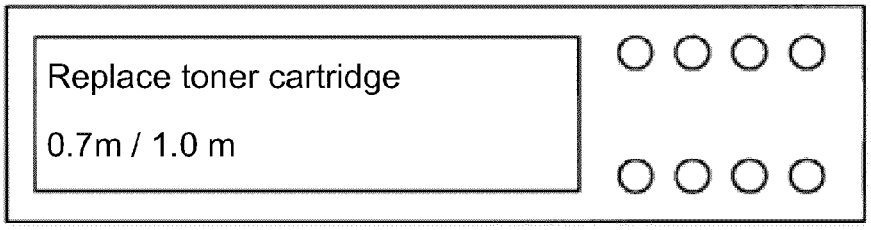
FIG. 11 is a schematic view showing an example No. 3 of the display state of the operation panel according to the first embodiment of the present invention.
Figure 12:
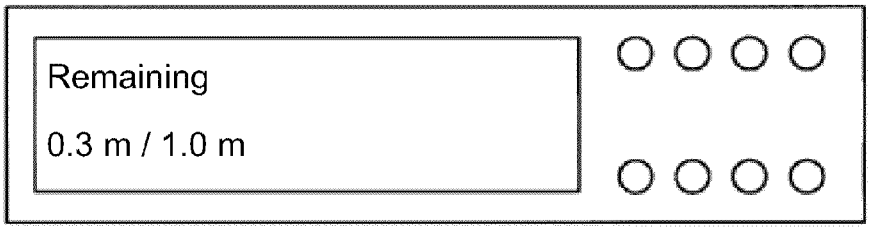
FIG. 12 is a schematic view showing an example No. 4 of the display state of the operation panel according to the first embodiment of the present invention.

FIG. 9 is a schematic view showing an example No. 1 of a display state of the operation panel 24 according to the first embodiment of the present invention. FIG. 10 is a schematic view showing an example No. 2 of the display state of the operation panel 24 according to the first embodiment of the present invention. FIG. 11 is a schematic view showing an example No. 3 of the display state of the operation panel 24 according to the first embodiment of the present invention. FIG. 12 is a schematic view showing an example No. 4 of the display state of the operation panel 24 according to the first embodiment of the present invention.

When the printer 10 receives the print data from the host computer as an upper level device, the image processing unit 51 analyzes the print data to generate the image data. Further, the image processing unit 51 retrieves a print duty and data corresponding to a requested print length or a length of the continuous sheet P requested with the print data upon performing the printing operation. Note that the print duty is defined as a ratio of a dot number where toner is actually attached relative to a total dot number in a unit image area.

When the consumable supply remaining amount detection unit 52 detects the toner remaining amount in each color, the consumable supply remaining amount determining unit 53 retrieves data of the toner remaining amount expressed in percentage and indicating how much toner remaining in the toner cartridge 40.

In the next step, the printable length detection unit 54 detects the printable length according to the toner remaining amount. Further, the actual print length determining unit 55 retrieves the print duty and the requested print length from the image processing unit 51, and retrieves the printable length from the printable length detection unit 54, thereby determining the actual print length.

A method of determining the actual print length will be explained next. In the embodiment, the printable length detection unit 54 includes the table of the relationship between the toner remaining amount and the printable length shown in FIG. 5. The table is created under a standard printing condition, and shows the toner remaining amount capable of printing 15,000 of A4 size sheets at the print duty of 5%. The A4 size sheet has a length of 297 mm in a longitudinal direction thereof, so that 15,000 of the A4 size sheets have a length of 4,500 m.

For example, when the toner remaining amount is 100% (the toner cartridge 40 is fully filled with toner), the printable length at the print duty of 15% is given by:

$$4{,}500\ (\mathrm{m})/(15(\%)/5(\%))=1{,}500\ (\mathrm{m})$$

In the embodiment, a printable length determining processing unit 71 is disposed in the actual print length determining unit 55 for performing a printable length determining process. More specifically, the printable length determining processing unit 71 in the actual print length determining unit 55 retrieves the printable length from the printable length detection unit 54 for determining whether the printable length is smaller than the requested print length.

In the embodiment, a printing processing unit 72 is disposed in the central control unit 56. When the printable length determining processing unit 71 determines that the printable length is greater than the requested print length, it is possible to perform the printing operation with no restriction. Accordingly, the printing processing unit 72 performs a printing process under a normal condition or a normal printing operation.

In the embodiment, a print pattern determining processing unit 73 is disposed in the actual print length determining unit 55. When the printable length determining processing unit 71 determines that the printable length is smaller than the requested print length, the print pattern determining processing unit 73 performs a print pattern determining process. More specifically, the print pattern determining processing unit 73 determines whether a print pattern to be printed with the print data is a repeated pattern shown in FIG. 6. FIG. 6 shows the example No. 1 of the repeated pattern, in which images (Image 1 to Image 10) with a length $\alpha$ are repeated and have an identical image.

In the embodiment, the print pattern determining processing unit 73 determines whether a copy type command is contained in the print data, or a copy number is more than two, so that the print pattern determining processing unit 73 determines whether the print pattern to be printed is the repeated pattern.

In the embodiment, an alarm processing unit 78 is disposed in the central control unit 56. When the print pattern determining processing unit 73 determines that the print pattern to be printed is not the repeated pattern, it is not possible to perform the normal printing operation. Accordingly, the alarm processing unit 78 performs an alarm process. More specifically, the alarm processing unit 78 displays a consumable supply replacing alarm on the operation panel 24, so that the operator is prompted to replace the toner cartridge 40 or cancel the normal printing operation.

When the operator replaces the toner cartridge 40, the printing processing unit 72 performs the normal printing operation. When the operator cancels the printing operation, a print job is cancelled, thereby completing the operation.

In the embodiment, a partially printable length calculation processing unit 74 is disposed in the actual print length determining unit 55. When the print pattern determining processing unit 73 determines that the print pattern to be printed is the repeated pattern, the partially printable length calculation processing unit 74 performs a partially printable length calculation process. More specifically, the partially printable length calculation processing unit 74 calculates a partially printable length indicating a range of the repeated pattern to be partially printable or a length of a partially printable range.

For example, it is assumed that the print pattern retrieved from the image processing unit 51 is the repeated pattern, in which the images (Image 1 to Image 10) with the length $\alpha$ of 0.1 m are repeated. Further, it is assumed that the print duty is 15%, and the printable length in the table of the printable length detection unit 54 is 2.1 m (at the print duty of 5%). In this case, the partially printable length is given by:

$$2.1\ (\mathrm{m})/(15(\%)/5(\%))=0.7\ \mathrm{m}$$

As described above, the repeated pattern has the images (Image 1 to Image 10) with the length $\alpha$ of 0.1 m. The partially printable length is divided by the length $\alpha$, and the following number is given by:

$$0.7\ (\mathrm{m})/0.1\ (\mathrm{m})=7$$

Accordingly, as shown in FIG. 7, seven images (Image 1 to Image 7) are arranged within the partially printable length corresponding to the toner remaining amount. In other words, as shown in FIG. 8, it is possible to perform a partial printing operation, in which a part of the print pattern, i.e., the seven images (Image 1 to Image 7), is printed. When the division of the partially printable length by the length $\alpha$ does not result in an integer number, the number of images is determined by an integer number portion of a result of the division.

As shown in FIG. 8, a print termination point is created between the image 7 and the image 8, where the printing operation is stopped. In the embodiment, the partially printable length calculation processing unit 74 calculates the print termination point according to the partially printable length and the length $\alpha$.

In the next step, the actual print length determining unit 55 sends the calculation result of the partially printable length calculation processing unit 74 to the central control unit 56.

In the embodiment, a display processing unit 75 is disposed in the central control unit 56. When the central control unit 56 receives the calculation result, the display processing unit 75 displays the calculation result on the operation panel 24 and waits for an instruction from the operator through the operation panel 24.

More specifically, as shown in FIG. 9, the display processing unit 75 displays the calculation result indicating that the partially printable length in the table of the printable length detection unit 54 is 2.1 m at the print duty of 5%. Further, as shown in FIG. 10, the display processing unit 75 displays the calculation result indicating that the partially printable length is 0.7 m relative to the requested print length of the images (Image 1 to Image 10) of 1.0 m.

In the next step, the operator decides whether the partial printing operation is permitted according to the partially printable length displayed on the operation panel 24. Accordingly, the operator pushes a permission key or a non-permission key (not shown) on the operation panel 24.

When the operator pushes the non-permission key, the print processing unit 72 determines that the partial printing operation is not permitted, and cancels the print job represented with the print data, thereby completing the operation.

When the operator pushes the permission key, the print processing unit 72 determines that the partial printing operation is permitted, and sends an instruction to the mechanism control unit 58 to start the partial printing operation. Accordingly, the mechanism control unit 58 sends instructions to the first register motor drive unit 59, the second register motor drive unit 60, the drum motor drive unit 61, the belt motor drive unit 62, the fixing motor drive unit 63, and the process control unit 64 to perform the partial printing operation of the images (Image 1 to Image 7).

In the embodiment, a discharge processing unit 76 is disposed in the central control unit 56. After the partial printing operation is complete, the discharge processing unit 76 performs a discharge process, so that the continuous sheet cutter 44 cuts the continuous sheet P and the continuous sheet P is temporarily discharged outside the printer 10.

In the embodiment, a termination processing unit 77 is disposed in the central control unit 56. The termination processing unit 77 performs a termination process, and sends an instruction to the mechanism control unit 58 to stop the printer 10. Accordingly, the mechanism control unit 58 stops the drum motor drive unit 61, the belt motor drive unit 62, the fixing motor drive unit 63, and the process control unit 64, thereby terminating the printing operation of the printer 10.

In the next step, as shown in FIG. 11, the alarm processing unit 78 displays the consumable supply replacing alarm on the operation panel 24, so that the operator can replace the toner cartridge 40.

In the embodiment, a toner cartridge sensor (not shown) is disposed in the image forming unit main body as a developer retaining unit detection unit. When the operator replaces the toner cartridge 40, the toner cartridge sensor detects that the toner cartridge 40 is replaced. Then, the printing processing unit 72 sends an instruction to the mechanism control unit 58 to start a printing operation for a remaining portion or a remaining printing operation. Accordingly, the mechanism control unit 58 sends instructions to the first register motor drive unit 59, the second register motor drive unit 60, the drum motor drive unit 61, the belt motor drive unit 62, the fixing motor drive unit 63, and the process control unit 64 to perform the remaining printing operation of the images (Image 8 to Image 10).

In the next step, as shown in FIG. 12, the display processing unit 75 displays a notice indicating that the remaining printing operation is performed over a length of 0.3 m as opposed to the requested print length of 1.0 m for the images (Image 1 to Image 10). After the remaining printing operation is complete, the printing processing unit 72 stops the printing operation.

As described above, in the embodiment, when the toner remaining amount decreases and the requested print length requested with the host computer exceeds the printable length, the partial printing operation is performed for printing a part of the print pattern. Accordingly, it is possible to improve availability of the printer 10. Further, when the printer 10 forms a color image, even if the toner remaining amount decreases in just one of the toner cartridge 40 and the requested print length exceeds the printable length, it is possible to continue the printing operation for forming the color image.

The flow charts shown in FIGS. 3 and 4 will be explained next. In step S1, the printer 10 receives the print data from the host computer. In step S2, the image processing unit 51 retrieves the print duty and the data corresponding to the requested print length. In step S3, the consumable supply remaining amount determining unit 53 retrieves the data of the toner remaining amount.

In step S4, the printable length determining processing unit 71 determines whether the printable length is smaller than the requested print length. When the printable length determining processing unit 71 determines that the printable length is smaller than the requested print length, the process proceeds to step S5. When the printable length determining processing unit 71 determines that the printable length is greater than the requested print length, the process proceeds to step S15.

In step S5, the print pattern determining processing unit 73 determines whether the print pattern is the repeated pattern. When the print pattern determining processing unit 73 determines that the print pattern is the repeated pattern, the process proceeds to step S6. When the print pattern determining processing unit 73 determines that the print pattern is not the repeated pattern, the process proceeds to step S16.

In step S6, the partially printable length calculation processing unit 74 calculates the partially printable length. In step S7, the display processing unit 75 displays the partially printable length. In step S8, the print processing unit 72 determines whether the partial printing operation is permitted. When the print processing unit 72 determines that the partial printing operation is permitted, the process proceeds to step S9. When the print processing unit 72 determines that the partial printing operation is not permitted, the printing operation is terminated.

In step S9, the partial printing operation is started. In step S10, it is determined whether the partial printing operation is complete. When it is determined that the partial printing operation is complete, the process proceeds to step S11. When it is determined that the partial printing operation is complete, the process returns to step S10.

In step S11, the alarm processing unit 78 displays the consumable supply replacing alarm. In step S12, it is determined whether the toner cartridge 40 is replaced. When it is determined that the toner cartridge 40 is replaced, the process proceeds to step S13. When it is determined that the toner cartridge 40 is not replaced, the process returns to step S12.

In step S13, the remaining printing operation is performed. In step S14, it is determined whether the remaining printing operation is complete. When it is determined that the remaining printing operation is complete, the printing operation is complete. When it is determined that the remaining printing operation is complete, the process returns to step S14.

In step S15, the normal printing operation is performed. In step S16, the alarm processing unit 78 displays the consumable supply replacing alarm. In step S17, it is determined whether the toner cartridge 40 is to be replaced or the printing operation is to be cancelled. When it is determined that the toner cartridge 40 is to be replaced, the process proceeds to step S15. When it is determined that the printing operation is to be cancelled, the printing operation is cancelled.

In the embodiment described above, when the partial printing operation is performed for printing the images (Image 1 to Image 7) corresponding to the partially printable length, the continuous sheet P is cut and is temporarily discharged outside the printer 10. Alternatively, it may be arranged such that the continuous sheet P stays in the printer 10 without being cut, and the printer 10 stops the printing operation, so that the toner cartridge 40 can be replaced.

Second Embodiment

A second embodiment of the present invention will be explained. In the second embodiment, the printer 10 is arranged such that the toner cartridge 40 can be replaced while the continuous sheet P stays in the printer 10. Components in the second embodiment similar to those in the first embodiment are designated with the same reference numerals, and explanations thereof are omitted. The components in the second embodiment similar to those in the first embodiment provide similar effects.

Figure 13:
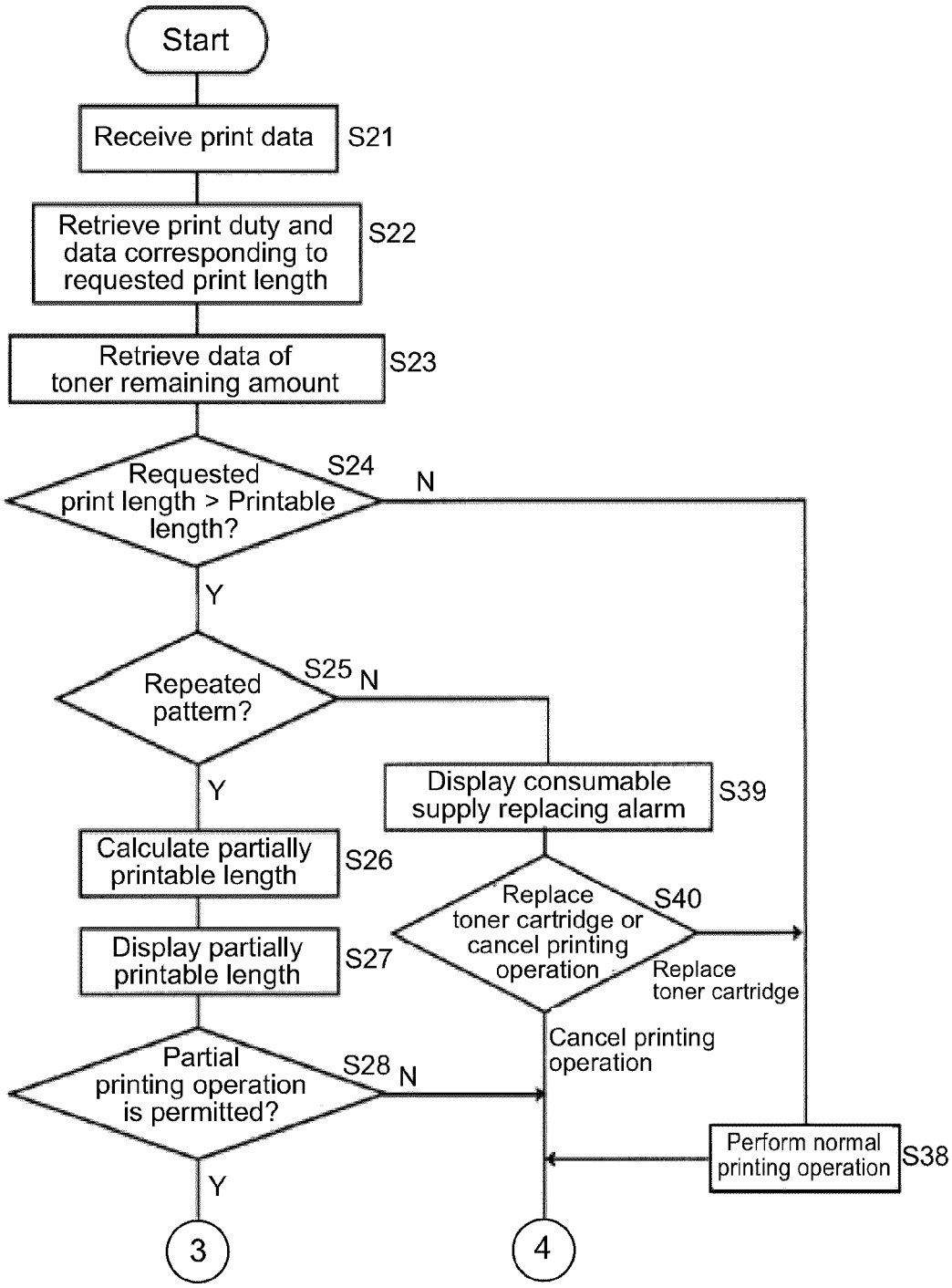
FIG. 13 is a flow chart No. 1 showing an operation of the printer according to a second embodiment of the present invention.
Figure 14:
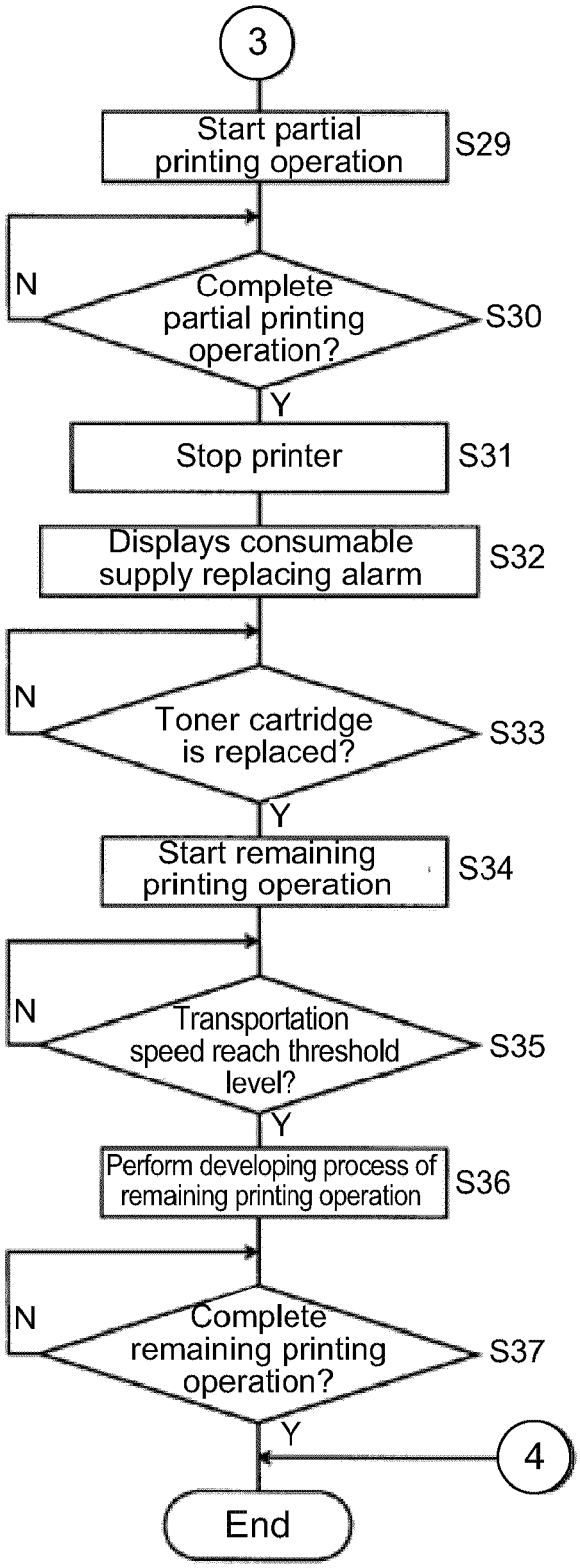
FIG. 14 is a flow chart No. 2 showing the operation of the printer according to the second embodiment of the present invention.
Figure 15:
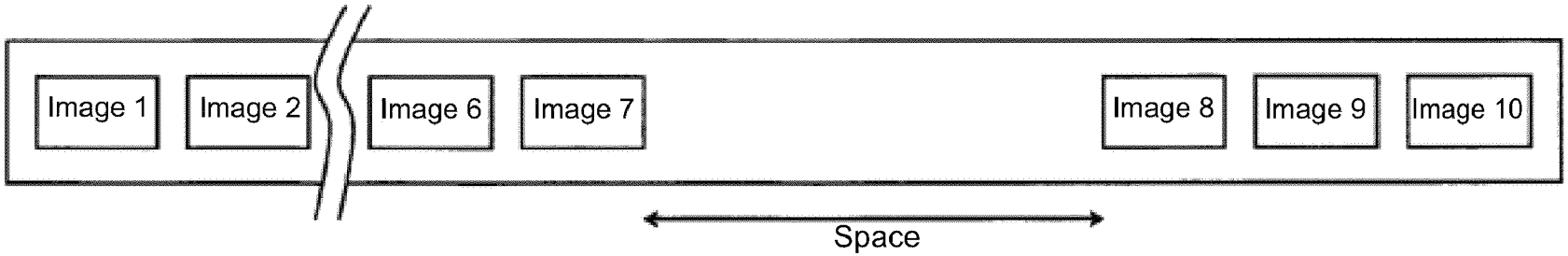
FIG. 15 is a schematic view showing an example of a printed image according to the second embodiment of the present invention.

FIG. 13 is a flow chart No. 1 showing an operation of the printer 10 according to the second embodiment of the present invention. FIG. 14 is a flow chart No. 2 showing the operation of the printer 10 according to the second embodiment of the present invention. FIG. 15 is a schematic view showing an example of a printed image according to the second embodiment of the present invention.

When the operator pushes the permission key, the print processing unit 72 determines that the partial printing operation is permitted, and sends an instruction to the mechanism control unit 58 as the second control unit to start the partial printing operation. Accordingly, the mechanism control unit 58 sends instructions to the first register motor drive unit 59 as the first transportation drive unit, the second register motor drive unit 60 as the second transportation drive unit, the drum motor drive unit 61 as the image forming drive unit, the belt motor drive unit 62 as the third transportation drive unit, the fixing motor drive unit 63 as the fixing drive unit, and the process control unit 64 as the third control unit to perform the partial printing operation of the images (Image 1 to Image 7).

In the embodiment, after the partial printing operation is complete, the termination processing unit 77 sends an instruction to the mechanism control unit 58 to stop the printer 10. Accordingly, the mechanism control unit 58 stops the first register motor drive unit 59, the second register motor drive unit 60, the drum motor drive unit 61, the belt motor drive unit 62, the fixing motor drive unit 63, and the process control unit 64, thereby terminating the printing operation of the printer 10. As a result, the printing operation of the printer 10 is stopped while the continuous sheet P stays in the printer 10 without being cut.

In the next step, as shown in FIG. 11, the alarm processing unit 78 displays the consumable supply replacing alarm on the operation panel 24, so that the operator can replace the toner cartridge 40.

In the embodiment, as described above, the toner cartridge sensor (not shown) is disposed in the image forming unit main body as the developer retaining unit detection unit. When the operator replaces the toner cartridge 40, the toner cartridge sensor detects that the toner cartridge 40 is replaced. Then, the printing processing unit 72 sends an instruction to the mechanism control unit 58 to start the remaining printing operation. Accordingly, the mechanism control unit 58 sends instructions to the first register motor drive unit 59, the second register motor drive unit 60, the drum motor drive unit 61, the belt motor drive unit 62, the fixing motor drive unit 63, and the process control unit 64 to perform the remaining printing operation of the images (Image 8 to Image 10).

In the next step, the belt motor drive unit 62 retrieves a rotational speed detected with an encoder (not shown) disposed on the belt motor as a rotational speed sensor, so that the belt motor drive unit 62 calculates a transportation speed of the continuous sheet P according to the rotational speed. Then, the printing processing unit 72 retrieves the transportation speed of the continuous sheet P to determine whether the transportation speed reaches a threshold level. When the printing processing unit 72 determines that the transportation speed reaches a threshold level, the printing processing unit 72 starts the developing process of the remaining printing operation.

In the embodiment, when the remaining printing operation is complete, the belt motor stops, thereby stopping the transportation of the continuous sheet P. The developing process does not start until the remaining printing operation starts and the transportation speed reaches the threshold level. Accordingly, as shown in FIG. 15, a space is created between the image 7 and the image 8.

As described above, in the embodiment, when the remaining printing operation is complete, the continuous sheet P is not discharged and stays in the printer 10. Accordingly, when the remaining printing operation is resumed, it is not necessary to supply the continuous sheet P or install a winder to the main body of the printer 10 after the continuous sheet P is discharged, thereby improving operability and efficiency of the printer 10.

The flow charts shown in FIGS. 13 and 14 will be explained next. In step S21, the printer 10 receives the print data from the host computer. In step S22, the image processing unit 51 retrieves the print duty and the data corresponding to the requested print length. In step S23, the consumable supply remaining amount determining unit 53 retrieves the data of the toner remaining amount.

In step S24, the printable length determining processing unit 71 determines whether the printable length is smaller than the requested print length. When the printable length determining processing unit 71 determines that the printable length is smaller than the requested print length, the process proceeds to step S25. When the printable length determining processing unit 71 determines that the printable length is greater than the requested print length, the process proceeds to step S38.

In step S25, the print pattern determining processing unit 73 determines whether the print pattern is the repeated pattern. When the print pattern determining processing unit 73 determines that the print pattern is the repeated pattern, the process proceeds to step S26. When the print pattern determining processing unit 73 determines that the print pattern is not the repeated pattern, the process proceeds to step S39.

In step S26, the partially printable length calculation processing unit 74 calculates the partially printable length. In step S27, the display processing unit 75 displays the partially printable length. In step S28, the print processing unit 72 determines whether the partial printing operation is permitted. When the print processing unit 72 determines that the partial printing operation is permitted, the process proceeds to step S29. When the print processing unit 72 determines that the partial printing operation is not permitted, the printing operation is terminated.

In step S29, the partial printing operation is started. In step S30, it is determined whether the partial printing operation is complete. When it is determined that the partial printing operation is complete, the process proceeds to step S31. When it is determined that the partial printing operation is complete, the process returns to step S30.

In step S31, the printing operation of the printer 10 is stopped. In step S32, the alarm processing unit 78 displays the consumable supply replacing alarm. In step S33, it is determined whether the toner cartridge 40 is replaced. When it is determined that the toner cartridge 40 is replaced, the process proceeds to step S34. When it is determined that the toner cartridge 40 is not replaced, the process returns to step S33.

In step S34, the remaining printing operation starts. In step S35, the printing processing unit 72 determines whether the transportation speed reaches the threshold level. When the printing processing unit 72 determines that the transportation speed reaches the threshold level, the process proceeds to step S36. When the printing processing unit 72 determines that the transportation speed does not reach the threshold level, the process returns to step S35.

In step S36, the developing process of the remaining printing operation is performed. In step S37, it is determined whether the remaining printing operation is complete. When it is determined that the remaining printing operation is complete, the printing operation is complete. When it is determined that the remaining printing operation is complete, the process returns to step S37.

In step S38, the normal printing operation is performed. In step S39, the alarm processing unit 78 displays the consumable supply replacing alarm. In step S40, it is determined whether the toner cartridge 40 is to be replaced or the printing operation is to be cancelled. When it is determined that the toner cartridge 40 is to be replaced, the process proceeds to step S38. When it is determined that the printing operation is to be cancelled, the printing operation is cancelled.

In the embodiments described above, the printer 10 is explained as an image forming apparatus. Alternatively, the present invention may be applicable to a copier, a facsimile, and a multi function product.

The disclosure of Japanese Patent Application No. 2008-324663, filed on Dec. 19, 2008, is incorporated in the application by the reference.

While the invention has been explained with reference to the specific embodiments of the invention, the explanation is illustrative and the invention is limited only by the appended claims.

What is claimed is:

1. An image forming apparatus, comprising:

a consumable supply remaining amount detection unit for detecting a remaining amount of a consumable supply;

a printable length detection unit for determining a printable length of a medium printable with the remaining amount;

a printable length determining processing unit for determining whether the printable length is smaller than a requested print length of the medium requested with print data;

a printing processing unit for performing a partial printing operation when the printable length determining processing unit determines that the printable length is smaller than the requested print length;

a print pattern determining processing unit for determining whether a print pattern to be printed with the print data is a repeated pattern; and a partially printable length calculation processing unit for calculating a partially printable length of the medium printable with the remaining amount when the print pattern determining processing unit determines that the print pattern to be printed is the repeated pattern so that the printing processing unit performs the partial printing operation of the partially printable length.

2. The image forming, apparatus according to claim 1, wherein said partially printable length calculation processing unit is arranged to calculate a print termination point according to the partially printable length.

3. The image forming apparatus according to claim 2, wherein said printing processing unit is arranged to cut the medium at the print termination point so that the medium is discharged outside the image forming apparatus after the medium is cut.

4. The image forming apparatus according to claim 1, wherein said printing processing unit is arranged to not perform the partial printing operation and notify a user when the print pattern determining processing unit determines that the print pattern is not the repeated pattern.

5. The image forming apparatus according to claim 1, wherein said partially printable length calculation processing unit is arranged to calculate a print termination point through dividing the partially printable length by a length of an image.

6. The image forming apparatus according to claim 1, wherein said printing processing unit is arranged to display a message for prompting exchange of the consumable supply when the printing processing unit completes the partial printing operation.

7. The image forming apparatus according to claim 6, wherein said printing processing unit is arranged to perform a remaining printing operation of the print data when the exchange of the consumable supply is detected.

8. An image forming apparatus comprising:

a consumable supply remaining amount detection unit for detecting a remaining amount of a consumable supply;

a printable length detection unit for determining a printable length of a medium printable with the remaining amount;

a printable length determining processing unit for determining whether the printable length is smaller than a requested print length of the medium requested with print data;

a printing processing unit for performing a partial printing operation when the printable length determining processing unit determines that the printable length is smaller than the requested print length; and a partially printable length calculation processing unit for calculating a partially printable length of the medium printable with the remaining amount so that the printing processing unit performs the partial printing operation of the partially printable length, wherein said partially printable length calculation processing unit is arranged to calculate a print termination point through dividing the partially printable length by a length of an image.

9. The image forming apparatus according to claim 8, wherein said printing processing unit is arranged to cut the medium at the print termination point so that the medium is discharged outside the image forming apparatus after the medium is cut.

10. The image forming apparatus according to claim 8, wherein said printing processing unit is arranged to not perform the partial printing operation and notify a user when the printable length determining processing unit determines that the printable length is greater than the requested print length.

11. The image forming apparatus according to claim 8, wherein said printing processing unit is arranged to display a message for prompting exchange of the consumable supply when the printing processing unit completes the partial printing operation.

12. The image forming apparatus according to claim 11, wherein said printing processing unit is arranged to perform a remaining printing operation of the print data when the exchange of the consumable supply is detected.

13. An image forming apparatus comprising:

a consumable supply remaining amount detection unit for detecting a remaining amount of a consumable supply;

a printable length detection unit for determining a printable length of a medium printable with the remaining amount;

a printable length determining processing unit for determining whether the printable length is smaller than a requested print length of the medium requested with print data; and a printing processing unit for performing partial printing operation when the printable length determining processing unit determines that the printable length is smaller than the requested print length;

wherein said printing processing unit is arranged to cut the medium at a print termination point after the printing processing unit performs the partial printing operation.

14. An image forming apparatus comprising:

a consumable supply remaining amount detection unit for detecting a remaining amount of a consumable supply;

a printable length detection unit for determining a printable length of a medium printable with the remaining amount;

a printable length determining processing unit for determining whether the printable length is smaller than a requested print length of the medium requested with print data; and a printing processing unit for performing a partial printing operation when the length determining processing unit determines that the printable length is smaller than the requested print length;

wherein said printing processing unit is arranged to cut the medium at a print termination point after the printing processing unit performs the partial printing operation, and said printing processing unit is arranged to perform a remaining printing operation without cutting the medium after the printing processing unit performs the partial printing operation.

* * * * *